United States Patent [19]

Leone et al.

[11] Patent Number: 4,751,010

[45] Date of Patent: Jun. 14, 1988

[54] SULFONATED AND SULFURIZED DETERGENT-DISPERSANT ADDITIVES FOR LUBRICATING OILS

[75] Inventors: Savino Leone, Tassin-La-Demi-Lune; Henri Gaessler, Meyzieu, both of France

[73] Assignee: Orogil, France

[21] Appl. No.: 882,169

[22] Filed: Jul. 7, 1986

[30] Foreign Application Priority Data

Jul. 8, 1985 [FR] France ..... 85 10399

[51] Int. Cl.[4] ..... C10M 135/00

[52] U.S. Cl. ..... 252/33; 252/18; 252/25; 252/33.4

[58] Field of Search ..... 252/33, 18, 25, 33.4

[56] References Cited

U.S. PATENT DOCUMENTS

| | | | |
|---|---|---|---|
| 3,429,811 | 2/1969 | Robbins et al. | 252/33 |
| 13,523,898 | 8/1970 | DeVault . | |
| 4,192,758 | 3/1980 | Dickey et al. | 252/33 |
| 4,251,379 | 2/1981 | Le Coent et al. | 252/33 |
| 4,615,841 | 10/1986 | Stamatakis et al. | 252/33 |

FOREIGN PATENT DOCUMENTS

| | | |
|---|---|---|
| 2,062,671 | 9/1970 | France . |
| 2,142,928 | 1/1985 | United Kingdom . |

*Primary Examiner*—Jacqueline V. Howard

[57] ABSTRACT

Disclosed are detergent-dispersant additives useful in lubricating oils prepared by neutralizing an alkylphenol sulfonic acid, followed by sulfurizing/over-alkalinizing the salt obtained and then carbonating the resultant salt.

Lubricating compositions comprising a lubricating oil and from about 1 to about 30% by weight of the final composition of a detergent-dispersant additive of the invention are also disclosed.

23 Claims, No Drawings

SULFONATED AND SULFURIZED DETERGENT-DISPERSANT ADDITIVES FOR LUBRICATING OILS

BACKGROUND OF THE INVENTION

1. Field of the Invention

The present invention relates to detergent-dispersant additives for lubricating oils, to methods for preparing such additives and to lubricating compositions comprising such additives. More particularly, the detergent-dispersant additives of the invention have a base of sulfurized and overalkalinized alkylphenate sulfonates derived from alkylphenol sulfonic acids. The additives of the present invention are resistant to hydrolysis and function as anti-oxidants.

2. Description of the Prior Art

Alkaline earth metal salts of alkylphenol sulfonic acids having a high content of sulfonate functional groups are known to be useful as dispersant additives for lubricating oils. Such uses are described, for example, in French Pat. No. 2,062,671 the disclosure of which is hereby incorporated herein by reference. These additives suffer from the disadvantage of not functioning as anti-oxidants.

SUMMARY OF THE INVENTION

The present invention relates to additives which are sulfurized alkaline-earth metal salts derived from alkylphenol sulfonic acids having a low content of sulfonate ($HSO_3$) functional groups (up to about one third the amount of hydroxyl (OH) functional groups present) and to methods of preparing such additives. The additives are stable to hydrolysis and function as anti-oxidizants. The present invention also relates to lubricating compositions comprising such additives.

DESCRIPTION OF THE PREFERRED EMBODIMENTS

The additives of the present invention are made by a process comprising:

(a) neutralizing an alkylphenol sulfonic acid having from 6 to 35 sulfonate functional groups per hundred hydroxyl (OH) functional groups by means of an alkaline-earth base, thus producing a salt, wherein the molar ratio of alkaline-earth base to sulfonate functional groups is at least about 1 and preferably ranges from about 1 to about 1.2, the neutralizing step being carried out in the presence of a first solvent capable of forming an azeotrope with water and, optionally, performing the neutralization in the presence of a neutralization catalyst;

(b) optionally adding dilution oil and then sulfurizing and over-alkalinizing said salt by contacting said salt with sulfur in the presence of (i) an alkaline-earth base that is added to the medium, (ii) a second solvent comprising a vector alcohol selected from the group consisting of alkylene glycols, alkoxy-alkanols, and mixtures thereof and (iii) a third solvent having a boiling point above 120° C. selected from the group consisting of aliphatic hydrocarbons, aromatic hydrocarbons, e.g., xylene, and alcohols (e.g., 2-ethylhexanol, decyl alcohol, or tridecyl alcohol), and mixtures thereof, to produce a sulfurized alkylphenate sulfonate , the quantities of reagents used corresponding to the following molar ratios:

sulfur/initial alkylphenol sulfonic acid ranging from about 0.4 to about 1.3, and preferably from about 0.6 to about 1.1 total alkaline-earth base (i.e., the total amount of alkaline earth base added in steps (a) and (b) above)/initial alkylphenol sulfonic acid ranging from about 1.5 to about 2.2, and preferably from about 1.7 to about 2 sulfurization-over-alkalinization alkaline-earth base-(i.e., the total amount of alkaline earth base added in step (b) above)/vector alcohol ranging from about 1.4 to about 2.5, and preferably from about 1.6 to about 2.3;

(c) carbonating the sulfurized alkylphenate sulfonate thus obtained with carbon dioxide at a temperature in the range of about 100° to about 185° C. under a pressure of about $93\times10^3$ to about $101\times10^3$Pa, the amount of carbon dioxide ($CO_2$) used being between that which can be completely absorbed by the reaction medium and an excess of about 30% over said amount;

(d) adding dilution oil;

(e) removing by distillation the second solvent, water and the third solvent;

(f) removing the sediments, e.g., by such methods as filtration or centrifugation.

The "alkylphenol sulfonic acid" used in the present invention is the mixture obtained by sulfonation of an alkylphenol by known methods, for instance, by means of sulfuric or chlorosulfonic acid or sulfuric anhydride and wherein the alkyl radical or radicals in said alkylphenol may have 8 to 30 carbon atoms, and preferably 12 to 30 carbon atoms. The mixture primarily comprises alkylphenol sulfonic acid and alkylphenol, the number of sulfonate functional groups ranging from 6 to 35 sulfonate functional groups per hundred hydroxyl functional groups in the mixture.

As used here, a mol of initial alkylphenol sulfonic acid shall include both sulfonated alkylphenols as well as non-sulfonated alkylphenols, the elementary unit considered being the OH function.

The alkaline-earth base reactant is selected from the group consisting of the oxides and hydroxides of calcium, barium or strontium, and preferably those of calcium.

The term "total alkaline earth base" refers to the amount of alkaline earth base that is added to neutralize the alkylphenol sulfonic acid in step (a) above and the amount that is added to over-alkalinize the salt in step (b) above.

The first step, neutralization of the alkylphenol sulfonic acid, as described in step (a) above (the neutralization step), is advantageously effected at about atmospheric pressure. The neutralization can be catalyzed by means of carboxyl (COOH) ions from carboxylic acids such as formic acid, acetic acid, glycolic acid; halogen ions, such as chlorides introduced by means of ammonium, calcium or zinc chloride; or amine ($NH_2$) functional groups such as polyethylene polyamines and, tris(2-oxa-6-amino-hexyl)amine. If a catalyst is used, the amount of catalyst used should be up to about 0.1 mol of carboxyl or halide ion or amine functional group per mol of initial alkylphenol sulfonic acid.

The first step is carried out at a temperature at least equal to the temperature of the formation of the water-first solvent azeotrope. The amount of first solvent used in the first step corresponds to that necessary in order to obtain a fluid medium, e.g., one having a viscosity of less than about $50\times10^{-6}$ m$^2$/sec (50cSt) under the reaction conditions. The first solvent may be selected from the group consisting of xylene, toluene, hexane, 2-ethylhexanol, oxoalcohols, decyl alcohol, tridecyl alcohol, 2-butoxyethanol, 2-butoxypropanol, and the methyl ether of propylene glycol and mixtures thereof.

Step (b) is carried out at a temperature in the range of about 140° to about 195° C. for about 3 to 6 hours. Dilution oil may be added in this step in order to decrease the viscosity of the medium to a value of less than about $50\times10^{-6}$ $m^2$/sec (50 cSt).

Over-alkalinization occurs in the initial portion of step (b), e.g., during about the initial 1 to 3 hours of that step. The initial portion of step (b) is desirably carried out at a lower temperature than the later portion of the step, e.g., typically the initial portion of this step is carried out in the range of about 140° to about 170° C. The over-alkalinization reaction may be catalyzed, like the neutralization step, by carboxyl or halogen ions, or amine functional groups, the amount of catalyst used being in the range up to 0.1 mol of carboxyl, halogen or amine functional group per mol of initial alkylphenol sulfonic acid.

The second solvent used in step (b) is selected from the group consisting of alkylene glycols such as ethylene glycol, diethylene glycol, propylene glycol, the alkoxy alkanols such as 2-butoxyethanol, 2-butoxypropanol, the methyl ether of propylene glycol and those alcohols having the formula $R(OR')_xOH$ in which R represents a methyl, ethyl or butyl radical, R' an ethyl or propyl radical and x is equal to 1 or 2, and mixtures of the foregoing alcohols.

The amount of third solvent used in the second step corresponds to that amount necessary in order to obtain a fluid medium, i.e., a medium of viscosity less than about $50\times10^{-6}$ $m^2$/sec (50 cSt) under the reaction conditions. The third solvent may be selected from the group consisting of xylene, 2-ethylhexanol, decyl alcohol and tridecyl alcohol and mixtures thereof.

The third step, carbonation, is advantageously carried out at a temperature in the range of about 145° to about 180° C., under a pressure of about $93\times10^3$ to about $101\times10^3$ Pa.

After carbonation, dilution oil is preferably introduced in amount necessary (taking into account any dilution oil that may have already been added in step (b)) so that the amount of dilution oil present in the final product is about 25 to about 65% by weight of the product, and most preferably about 30 to about 50% by weight of product. Suitable dilution oils may be selected from the group consisting of paraffin oils such as neutral oil 100, naphthenic oils and mixtures of the foregoing oils.

The additives of the invention are of high basicity. For example, the TBN (Total Basic Number-ASTM Standard D2896) of the additives of the invention that have a base of calcium salts may easily reach 250.

The amount of additive to be used in order to improve the detergent-dispersant properties of a lubricating oil is a function of the intended use of such oil. Thus for a gasoline-engine oil, the amount of additives to be added is generally in the range of 1 to 3% by weight; for a diesel-engine oil it is generally in the range of 1.5 to 5% by weight; for a marine-engine oil it is generally in the range of 10 to 30% by weight.

The lubricating oils which can thus be improved may be selected from among a great variety of lubricating oils, such as naphthene-base, paraffin-base and mixed-base lubricating oils, other hydrocarbon lubricants, for instance, lubricating oils derived from coal products and synthetic oils, for instance alkylene polymers, polymers of the alkylene oxide type and their derivatives, including the alkylene-oxide polymers prepared by polymerizing alkylene oxide in the presence of water or alcohols, for example, ethyl alcohol, esters of dicarboxylic acids, liquid esters of phosphorus acids, alkylbenzenes and dialkylbenzenes, polyphenyls, alkylbiphenylethers and polymers of silicon.

In addition to the detergent-dispersant additives of the present invention, other additives may also be present in the lubricating oils of the present invention, such additional additives including anti-oxidant, anti-corrosion and ash-free dispersant additives.

EXAMPLES

The following examples present illustrative, but non-limiting, embodiments of the present invention.

EXAMPLE 1

Preparation Of A Sulfonic Acid

A dodecylphenol sulfonic acid containing 20 sulfonate functional groups per hundred hydroxyl functional groups is prepared by the action of concentrated sulfuric acid (100 g, 96% by weight) on dodecylphenol (1048 g) in the presence of hexane (270 g). The water and the hexane are removed from the medium by azeotropic distillation.

Neutralization

Calcium hydroxide (57 g) and 2-ethylhexanol (170 g) are added to the dodecylphenol sulfonic acid (1035 g) prepared in the preceding step to form a neutralization product. The medium is heated with agitation to the temperature at which distillation of the resulting water/2-ethylhexanol azetrope begins. After 30 minutes at this temperature, the reaction is complete and the medium is cooled.

Sulfurization/Over-Alkalinization

Calcium hydroxide (400 g), calcium chloride dihydrate (30 g), sulfur (97 g) and neutral oil 100 (385 g) are added to the neutralized product. The medium is heated to 150° C. with agitation under a slight vacuum ($98\times10^3$ Pa). A mixture of glycol (170 g) and 2-ethylhexanol (50 g) is then added over the course of 20 minutes. The water is removed by distillation of the water/2-ethylhexanol azeotrope. Additional 2-ethylhexanol (480 g) is then added, the pressure brought to $96.5\times10^3$ Pa and the temperature held at 165° C. for one hour.

Carbonation

The product obtained from the preceding step, maintained at the same temperature and pressure, is carbonated by bubbling $CO_2$ through it at a rate of 2 g/minute for about one hour. Neutral oil 100 (384 g) is then introduced to the medium. Thereafter the alcohols in the medium are removed by distillation under reduced pressure (195° C./$6\times10^3$ Pa). The sediment is removed by centrifugation.

The additive obtained has a TBN of 256 (ASTM Standard D2896). Its resistance to hydrolysis is 93%, measured in accordance with the following test.

Resistance to Hydrolysis

A 1% solution by weight of calcium of the additive to be tested is prepared in CFR 350 neutral oil. Water is added to obtain a solution containing 2% by weight of water. The solution obtained is maintained at 93° C. for 70 hours and then filtered.

The TBN of the filtrate is measured. The ratio of the TBN of the filtrate to the TBN of the initial additive in percent indicates the resistance of the additive to hydrolysis.

EXAMPLE 2

Neutralization

Hexane (250 g) and calcium hydroxide (60 g) are added to dodecylphenol sulfonic acid (1035 g) containing 20 sulfonate functional groups per hundred hydroxyl functional groups obtained by the method of Example 1 to form a neutralization product. The medium is heated with agitation to the temperature at which distillation of the water/hexane azeotrope occurs. After 30 minutes at this temperature, the reaction is complete, the hexane is removed by distillation and the medium is cooled.

Sulfurization/Over-Alkalinization

Calcium hydroxide (400 g), sulfur (125 g), ammonium chloride (10 g) and neutral oil 100 (385 g) are added to the neutralized product. The medium is heated to 150° C. with agitation under a slight vacuum ($98\times10^3$ Pa). 2-Ethylhexanol (170 g) is then added and a mixture of 2-butoxyethanol (325 g) and 2-ethylhexanol (50 g) is then introduced over the course of 30 minutes. The water is eliminated by distillation of the water/2-ethylhexanol azeotrope. Additional 2-ethylhexanol (480 g) is then added, the pressure brought to $96.5\times10^3$ Pa and the temperature maintained at 165° C. for one hour.

Carbonation

The product obtained from the preceding step, maintained at the same temperature and pressure, is carbonated by bubbling $CO_2$ through it at a rate of 2 g/minute for about one hour. Neutral oil 100 (385 g) is then introduced to the medium. Thereafter the alcohols are removed by distillation under reduced pressure ($6\times10^3$ Pa). The sediment is removed by centrifugation.

The additive obtained has a TBN of 250.

EXAMPLE 3

Neutralization

Calcium oxide (41 g) and xylene (285 g) are added to dodecylphenol sulfonic acid (1025 g) containing 19.4 sulfonate functional groups per hundred hydroxyl functional groups obtained by the method of Example 1 to form a neutralization product. The medium is heated with agitation to the temperature at which distillation of the water/xylene azeotrope begins. After 30 minutes at this temperature, the reaction is complete and the medium is cooled.

Sulfurization/Over-Alkalinization

Calcium oxide (337 g), sulfur (120 g) and xylene (82 g) are added to the neutralized product. The medium is heated to 140° C. with agitation under slight vacuum ($98\times10^3$ Pa). Glycol (225 g) is then added over the course of 30 minutes. The water is removed by distillation of the water/xylene azeotrope. Additional xylene (205 g) is then added and the reaction continued at the same temperature for 1.5 hours.

Carbonation

The product obtained from the preceding step, maintained at the same conditions of temperature and pressure, is carbonated by bubbling $CO_2$ through it at a rate of 2 g/minute for about one hour. Neutral 100 oil (720 g) is then introduced to the medium. Thereafter the glycol and the xylene are removed by distillation under reduced pressure (195° C./$6\times10^3$ Pa). The sediment is removed by centrifugation.

The additive obtained has a TBN of 284.

EXAMPLE 4

An alkylphenol sulfonic acid containing 21 sulfonate functional groups per hundred hydroxyl functional group is prepared by the action of sulfur trioxide diluted with nitrogen (2% by volume) on a mixture of p-dodecylphenol (1860 g) and tetracosylphenol (800 g) in the presence of hexane (670 g), at a temperature of between 5° and 10° C. The hexane is evaporated under reduced pressure ($6\times10^3$ Pa) by heating to 30° C.

Neutralization

Calcium hydroxide (63 g), 2-ethylhexanol (300 g) and dihydrated calcium chloride (30 g) are added to alkylphenol sulfonic acid (1153 g) to form a neutralization product. The medium is heated with agitation to the temperature at which distillation of the water/2-ethylhexanol azeotrope begins. After 30 minutes at this temperature, the reaction is complete and the medium cooled.

Sulfurization/Over-Alkalinization

Calcium hydroxide (417 g), sulfur (120 g) and neutral oil 100 (385 g) are added to the neutralized product. The medium is heated to 155° C. with agitation under slight vacuum ($98\times10^3$ Pa). Glycol (210 g) is then added over the course of 30 minutes. The water is eliminated by distillation of the water/2-ethyl hexanol azeotrope. Additional 2-ethylhexanol (400 g) is then added, the pressure brought to $96.5\times10^3$ Pa and the temperature held at 165° C. for one hour.

Carbonation

The product obtained from the preceding step, maintained at the same pressure and temperature conditions, is carbonated by bubbling $CO_2$ through it at a rate of 2 g/minute for about one hour. Neutral oil 100 (385 g) is then added to the medium. Thereafter the alcohols are removed by distillation under reduced pressure (195° C./$6\times10^3$ Pa). The sediment is removed by centrifugation.

The additive obtained has a TBN of 250.

EXAMPLE 5

A dodecylphenol sulfonic acid containing 35 sulfonate functional groups per hundred hydroxyl functional groups is prepared by the action of sulfur trioxide diluted with nitrogen (2% by volume) on p-dodecylphenol (1048 g) in the presence of hexane (300 g), at a temperature of between 5° and 10° C. The hexane is evaporated under reduced pressure ($6\times10^3$ Pa) by heating to 30° C.

Neutralization

Calcium hydroxide (105 g) and 2-ethylhexanol (250 g) are added to dodecylphenol sulfonic acid (1075 g) to form a neutralization product. The medium is heated with agitation until the water/2-ethylhexanol azeotrope begins to distill. After 30 minutes at this temperature, the reaction is complete and the medium is cooled.

Sulfurization/Over-Alkalinization

Calcium hydroxide (317 g), sulfur (73 g), neutral oil 100 (385 g) and tetraethylene pentamine (15 g) are added to the neturalized product. The medium is heated to 150° C. with agitation and under slight vacuum ($98\times10^3$ Pa). A mixture of glycol (180 g) and 2-ethylhexanol (70 g) is then added over the course of 30 minutes. The water is eliminated by distillation of the water/2-ethylhexanol azeotrope. Additional 2-ethylhexanol (480 g) is then added, the pressure brought to $96.5\times10^3$ Pa and the temperature held at 165° C. for one hour.

Carbonation

The product obtained from the preceding step, maintained at the same pressure and temperature conditions, is carbonated by bubbling $CO_2$ through it at a rate of 2 g/minute for about one hour. Neutral oil 100 (385 g) is then added to the medium. Thereafter the alcohols are eliminated by distillation under reduced pressure (195° C./$6\times10^3$ Pa). The sediment is removed by centrifugation.

The additive obtained has a TBN of 252.

EXAMPLE 6

Neutralization

2-Ethylhexanol (350 g), calcium hydroxide (70 g) and calcium chloride dihydrate (30 g) are added to dodecylphenol sulfonic acid (1015 g) containing 20 sulfonate functional groups per hundred hydroxyl functional groups, obtained by the method of Example 1 to form a neutralization product. The medium is heated with agitation to the temperature at which distillation of the water/2-ethyl haxanol azeotrope begins. After 30 minutes at this temperature, the reaction is complete and the medium cooled.

Sulfurization/Over-Alkalinization

Calcium hydroxide (440 g), sulfur (106 g) and neutral oil 100 (385 g) are added to the neutralized product. The medium is heated to 150° C. with agitation under slight vacuum ($98\times10^3$ Pa).

A mixture of ethylene glycol (170 g) and 2-ethylhexanol (350 g) is then added over the course of an hour. The water is removed by distillation of the water/2-ethylhexanol azeotrope. The pressure is brought to $96.5\times10^3$ Pa and the temperature held at 165° C. for one hour.

Carbonation

The product obtained from the preceding step, maintained at the same pressure and temperature, is carbonated by bubbling $CO_2$ through it at a rate of 2 g/minute for about one hour. Neutral oil 100 (350 g) and antifoam (4 ml) are then introduced to the medium. Thereafter the alcohols are removed by distillation under reduced pressure (195° C./$6\times10^3$ Pa). The sediment is removed by centrifugation.

The additive obtained has a TBN of 280.

We claim:

1. A detergent-dispersant additive for lubricating oils made by a process comprising:
   (a) neutralizing, in the presence of a first solvent capable of forming an azeotrope with water, an alkylphenol sulfonic acid having a number of sulfonate ($HSO_3$) functional groups ranging from 6 to 35 sulfonate functional groups per hundred hydroxyl (OH) functional groups by means of an alkaline-earth base, thus producing a salt, wherein the molar ratio of alkaline-earth base to sulfonate functional group is at least about 1;
   (b) sulfurizing and over-alkalinizing said salt by contacting said salt with sulfur in the presence of (i) an alkaline-earth base that is added to the reaction medium, (ii) a second solvent comprising a vector alcohol selected from the group consisting of alkylene glycols and alkoxy alkanols and mixtures thereof, and (iii) a third solvent having a boiling point above 120° C. selected from the group consisting of aliphatic hydrocarbons, aromatic hydrocarbons and alcohols and mixtures thereof to produce a sulfurized alkylphenate sulfonate, the quantities of reagents used corresponding to the following molar ratios:
      sulfur/initial alkylphenol sulfonic acid ranging from about 0.4 to about 1.3
      total alkaline-earth base/initial alkylphenol sulfonic acid ranging from about 1.5 to about 2.2
      sulfurization-over-alkalinization alkaline-earth base/vector alcohol ranging from about 1.4 to about 2.5;
   (c) carbonating said sulfurized alkylphenate sulfonate with carbon dioxide at a temperature in the range of about 100° to about 185° C. under a pressure of about $93\times10^3$ to about $101\times10^3$ Pa, the amount of said carbon dioxide used being between that which can be completely absorbed by the reaction medium and an excess of about 30% over said amount;
   (d) adding dilution oil;
   (e) removing by distillation the second solvent, water and the third solvent; and
   (f) removing the sediments.

2. The detergent-dispersant additive of claim 1 wherein dilution oil is added after step (a) and before step (b).

3. The detergent-dispersant additive of claim 1 wherein step (a) is carried out in the presence of a neutralization catalyst.

4. The detergent-dispersant additive of claim 1 wherein the amounts of reagents used in steps (a) and (b) correspond to the following molar ratios:
   alkaline-earth base used in step (a)/sulfonate functional groups ranging from about 1 to about 1.2
   sulfur/initial alkylphenol sulfonic acid ranging from about 0.6 to about 1.1
   total alkaline-earth base/initial alkylphenol sulfonic acid ranging from about 1.7 to about 2
   sulfurization-over-alkalinization alkaline-earth base/-vector alcohol ranging from about 1.6 to about 2.3.

5. The detergent-dispersant additive of claim 1 wherein the alkaline-earth base is an oxide selected from the group consisting of oxides of calcium, barium and strontium and mixtures thereof.

6. The detergent-dispersant additive of claim 1 wherein the alkaline-earth base is a hydroxide selected from the group consisting of hydroxides of calcium, barium and strontium and mixtures thereof.

7. The detergent-dispersant additive of claim 1 wherein the second solvent is an alkylene glycol selected from the group consisting ethylene glycol, diethylene glycol and propylene glycol and mixtures thereof.

8. The detergent-dispersant additive of claim 1 wherein the second solvent is an the alkoxy alkanol having the formula $R(OR')_xOH$, wherein R represents a methyl, ethyl or butyl radical, R' represents an ethyl or propyl radical and x is equal to 1 or 2.

9. The detergent-dispersant additive of claim 1 wherein at least one of steps (a) and (b) is carried out in the presence of up to about 0.1 mol of catalyst selected from the group consisting of carboxyl ions, halogen ion and amine functional groups and mixtures thereof.

10. The detergent-dispersant additive of claim 1 wherein step (b) is carried out at a temperature in the range of about 140° to about 195° C.

11. The detergent-dispersant additive of claim 1 wherein the carbonation step is carried out at a temperature in the range of about 145° to about 180° C.

12. A process for preparing a detergent-dispersant additive comprising:

(a) neutralizing in the presence of a first solvent capable of forming an azeotrope with water an alkylphenol sulfonic acid having a number of sulfonate ($HSO_3$) functional groups ranging from 6 to 35 sulfonate functional groups per hundred hydroxyl (OH) functional groups by means of an alkaline-earth base thus producing a salt, wherein the molar ratio of alkaline-earth base to sulfonate functional group is at least about 1;

(b) sulfurizing and over-alkalinizing said salt by contacting said salt with sulfur in the presence of (i) an alkaline-earth base that is added to the reaction medium, (ii) a second solvent comprising a vector alcohol selected from the group consisting of alkylene glycols and alkoxy alkanols and mixtures thereof, and (iii) a third solvent having a boiling point above 120° C. selected from the group consisting of aliphatic hydrocarbons, aromatic hydrocarbons and alcohols and mixtures thereof to produce a sulfurized alkylphenyl sulfonate, the quantities of reagents used corresponding to the following molar ratios:

sulfur/initial alkylphenol sulfonic acid ranging from about 0.4 to about 1.3 total alkaline-earth base/initial alkylphenol sulfonic acid ranging from about 1.5 to about 2.2 sulfurization-over-alkalinization alkaline-earth base/vector alcohol, ranging from about 1.4 to about 2.5;

(c) carbonating said sulfurized alkylphenate sulfonate with carbon dioxide at a temperature in the range of about 100° to about 185° C. under a pressure of about $93\times10^3$ to about $101\times10^3$ Pa, the amount of said carbon dioxide used being between that which can be completely absorbed by the reaction medium and an excess of about 30% over said amount;

(d) adding dilution oil;

(e) removing by distillation the second solvent, water and the third solvent; and (f) removing the sediments.

13. The process of claim 12 wherein dilution oil is added after step (a) and before step (b).

14. The process of claim 12 wherein step (a) is carried out in the presence of a neutralization catalyst.

15. The process of claim 12 wherein the amounts of reagents used in steps (a) and (b) correspond to the following molar ratios:

alkaline-earth base used in step (a)/sulfonate functional group ranging from about 1 to about 1.2 sulfur/initial alkylphenol sulfonic acid ranging from about 0.6 to about 1.1 total alkaline-earth base/initial alkylphenol sulfonic acid ranging from about 1.7 about 2 sulfurization/over-alkalinization alkaline-earth base/vector alcohol ranging from about 1.6 to about 2.3.

16. The process of claim 12 wherein the alkaline-earth base is an oxide selected from the group consisting of oxides of calcium, barium and strontium and mixtures thereof.

17. The process of claim 12 wherein the alkaline-earth base is a hydroxide selected from the group consisting of hydroxides of calcium, barium and strontium and mixtures thereof.

18. The process of claim 12 wherein the second solvent is an alkylene glycol selected from the group consisting of ethylene glycol, diethylene glycol and propylene glycol and mixtures thereof.

19. The process of claim 12 wherein the second solvent is an alkoxy alkanol having the formula $R(OR')_xOH$, wherein R represents a methyl, ethyl or butyl radical, R' represents an ethyl or propyl radical and x is equal to 1 or 2.

20. The process of claim 12 wherein at least one of steps (a) and (b) is carried out in the presence of up to about 0.1 mol of catalyst selected from the group consisting of carboxyl ions, halogen ions and amine functional groups and mixtures thereof.

21. The process of claim 12 wherein step (b) is carried out at a temperature in the range of about 140° to about 195° C.

22. The process of claim 12 wherein the carbonation step is carried out at a temperature in the range of about 145° to about 180° C.

23. A lubricating composition comprising a lubricating oil and from about 1 to about 30% by weight of the final composition of the detergent-dispersant additive of claim 1.

* * * * *